US008960746B2

(12) United States Patent
Syrowik

(10) Patent No.: US 8,960,746 B2
(45) Date of Patent: Feb. 24, 2015

(54) UNDERWATER MAGNETIC RETRIEVAL APPARATUS

(75) Inventor: Mathew R. Syrowik, Southfield, MI (US)

(73) Assignee: David R. Syrowik, Milford, MI (US)

( * ) Notice: Subject to any disclaimer, the term of this patent is extended or adjusted under 35 U.S.C. 154(b) by 21 days.

(21) Appl. No.: 13/563,795

(22) Filed: Aug. 1, 2012

(65) Prior Publication Data

US 2014/0037418 A1 Feb. 6, 2014

(51) Int. Cl.
*B66C 1/04* (2006.01)

(52) U.S. Cl.
USPC ..... 294/65.5; 294/66.1

(58) Field of Classification Search
CPC ..... B63C 7/22; B63C 11/48; B63C 11/50; B66C 1/04; B25B 11/002; H01F 7/206; B65G 7/12
USPC ..... 294/66.2, 66.1, 65.5, 149, 190, 74, 294/82.13
See application file for complete search history.

(56) References Cited

U.S. PATENT DOCUMENTS

| | | | | | |
|---|---|---|---|---|---|
| 1,212,870 | A * | 1/1917 | Zolper | 294/65.5 |
| 1,606,898 | A * | 11/1926 | Robinson | 294/86.4 |
| 2,056,906 | A | 4/1935 | Parkhill | |
| 2,555,430 | A * | 6/1951 | Weeks | 280/480 |
| 2,626,175 | A * | 1/1953 | Jessop | 294/82.11 |
| 2,778,669 | A * | 1/1957 | Goodwin | 294/65.5 |
| 2,837,702 | A * | 6/1958 | Blind | 335/291 |
| 2,879,618 | A * | 3/1959 | Kirkland, Jr. | 43/17.2 |
| 3,183,417 | A * | 5/1965 | Wright | 335/294 |
| 4,017,386 | A | 4/1977 | Barry | |
| 4,264,887 | A * | 4/1981 | Barrett | 335/291 |
| 4,756,567 | A * | 7/1988 | Nilson | 294/74 |
| 4,965,695 | A * | 10/1990 | Baumann | 361/142 |
| 5,395,148 | A * | 3/1995 | Jameson et al. | 294/65.5 |
| 5,408,818 | A | 4/1995 | Damron | |
| 5,429,402 | A | 7/1995 | Kennedy | |
| 5,979,957 | A | 11/1999 | Conrad et al. | |
| 6,113,169 | A | 9/2000 | Gohman et al. | |
| 6,142,310 | A | 11/2000 | Haase et al. | |
| 6,677,846 | B2 * | 1/2004 | Snider | 335/302 |
| 6,683,521 | B2 * | 1/2004 | Snider | 335/302 |
| 7,137,449 | B2 * | 11/2006 | Silguero | 166/301 |
| 7,331,470 | B2 | 2/2008 | Vernon et al. | |
| 7,419,198 | B2 * | 9/2008 | Baker et al. | 294/74 |
| 2011/0043310 | A1 * | 2/2011 | Cardone et al. | 335/289 |

* cited by examiner

*Primary Examiner* — Saul Rodriguez
*Assistant Examiner* — Gabriela Puig
(74) *Attorney, Agent, or Firm* — Brooks Kushman P.C.

(57) ABSTRACT

An underwater magnetic retrieval apparatus and method utilizing same are provided. The apparatus is specifically constructed for underwater retrieval of a magnetically-attractable object. The apparatus includes at least one housing including at least two spaced attachment portions, a plurality of magnets disposed within the at least one housing and at least one line extending from the two spaced attachment portions of the at least one housing to facilitate underwater manipulation of the apparatus and underwater retrieval of the magnetically-attractable object.

15 Claims, 5 Drawing Sheets

UNDERWATER MAGNETIC RETRIEVAL APPARATUS

TECHNICAL FIELD

In general, this invention relates to devices and methods using magnetic attraction for underwater retrieval, recovery and/or pickup of one or more magnetically-attractable objects.

BACKGROUND

A variety of objects may inadvertently fall or drop into a body of water, such as an ocean, sea, gulf, bay, lake, pond, river, waterfall, stream, creek, or a swimming pool. The variety of objects may include, for example, a set of keys, a motor, an electronic device, a tool, an anchor, a piece of jewelry as well as other objects. For example, a person may accidentally drop a hand-held electronic device, such as a mobile phone, camera, pager, digital assistant, personal navigation device, or tablet computer, into water. In other examples, a set of car and house keys may fall off a boat into water; an outboard motor may be dropped from a boat and sink underwater; a tool, such as a wrench or flashlight, may fall off a dock or boat and sink underwater; and jewelry, such as a watch or necklace, may be dropped into water.

Other objects may be put into a body of water. For example, a person may throw a weapon, such as a gun, in attempt to hide the weapon underwater. In another example, an object may be located in a body of water as a result of a shipwreck, an accident, or natural disaster (e.g., flood, hurricane, tsunami, et cetera).

When an object falls or is otherwise put into water, the weight of the object is often greater than the buoyance force exerted by the water and, therefore, the object sinks below the surface of the water. It is often desirable or necessary to retrieve, recover, and/or pickup or otherwise gain access to the object. Furthermore, it may be desirable or necessary to at least partially retrieve, recover, and/or pick up the object from the body of water. However, it can be difficult to locate, retrieve, recover, pickup, or gain access to the object due a number of factors, such as the water depth, water visibility, bottom composition, and water movement (e.g., tide, current, waves, et cetera).

Oftentimes one or more of such objects or other item includes a ferromagnetic material or a ferrimagnetic material that can be magnetized and attracted to a magnet. A ferromagnetic or ferrimagnetic material includes, for example, iron, nickel, cobalt, and alloys of certain rare earth metals.

SUMMARY

An object of at least one embodiment of the present invention is to provide a low cost apparatus and a method for utilizing the apparatus to efficiently retrieve magnetically-attractable objects which are located under water.

In carrying out the above object and other objects of the present invention, an apparatus for underwater retrieval of a magnetically-attractable object is provided. The apparatus includes at least one housing including at least two spaced attachment portions, a plurality of magnets disposed within the at least one housing and at least one line extending from the two spaced attachment portions of the at least one housing to facilitate underwater manipulation of the apparatus and underwater retrieval of the magnetically-attractable object.

The at least one housing may include at least one sealed housing which completely encloses the magnets to prevent water from entering the housing during the underwater retrieval of the magnetically-attractable object.

The at least one housing may define an elongated intermediate portion between the two spaced attachment portions. Most of the magnets are disposed within the elongated intermediate portion of the at least one housing.

The at least one housing may have a cylindrical pill shape to limit debris interference with the at least one housing during the underwater retrieval of the magnetically-attractable object.

The at least one housing may have a bar-shaped intermediate portion defining a lower planar surface between the two spaced attachment portions. Most of the magnets may be disposed within the at least one housing above the lower planar surface of the bar-shaped intermediate portion of the at least one housing.

The plurality of magnets may be permanent magnets.

The plurality of magnets may be electromagnets and the line may include an electrically conductive wire for selectively carrying electric current to magnetize the electromagnets.

The magnets may be arranged in a tandem manner within the at least one housing.

The at least one housing may include a plurality of donut-shaped intermediate portions between the two spaced attachment portions. Each of the donut-shaped intermediate portions may have at least one of the magnets and define a hole. The line may pass through the hole of each of the donut-shaped intermediate portions to facilitate rotation of the donut-shaped intermediate portions about the line and underwater retrieval of the magnetically-attractable object.

The spaced attachment portions may extend from the at least one housing and define an angle relative to each other along a longitudinal axis of the at least one housing. The angle may be between zero degrees and 180 degrees.

The spaced attachment portions may extend in a single direction from the at least one housing. The at least one line may extend from the two spaced attachment portions of the housing in a second direction different from the single direction of the attachment portions during underwater manipulation of the apparatus.

Each of the spaced attachment portions may define an inlet. The line may be inserted through the inlet of at least one of the spaced attachment portions to facilitate underwater manipulation of the apparatus.

The inlets of the spaced attachment portions may be coaxial. The line may be inserted coaxially through the inlet of each of the spaced attachment portions to facilitate underwater manipulation of the apparatus.

The spaced attachment portions may be at opposing ends of the at least one housing. The at least one line may extend from the opposing ends of the at least one housing.

Further in carrying out the above object and other objects of at least one embodiment of the present invention, an apparatus for underwater retrieval of a magnetically-attractable object is provided. The apparatus includes at least one housing including at least two spaced attachment portions and a plurality of magnets disposed within the at least one housing. Each of the attachment portions is apertured to receive a line which extends from each of the two spaced attachment portions of the at least one housing to facilitate underwater manipulation of the apparatus and underwater retrieval of the magnetically-attractable object.

The plurality of magnets may be electromagnets and at least one of the lines may include an electrically conductive wire for carrying electrical current to selectively magnetize the electromagnets.

The apparatus may further include a controller. The controller may be configured to transmit a first signal through the electrically conductive wire to the electromagnets, to receive a second signal from the electromagnets, and to determine whether the apparatus has magnetically attracted the magnetically-attractable object based on at least one of the signals.

Still further in carrying out the above object and other objects of at least one embodiment of the present invention, a method of underwater retrieving a magnetically-attractable object is provided. The method includes providing an apparatus having at least one housing including at least two spaced attachment portions, a plurality of magnets disposed within the at least one housing and at least one line extending from the two spaced attachment portions of the at least one housing. The method also includes lowering the apparatus into water, moving the line to move the apparatus in the water towards the at least one magnetically-attractable object and attracting the magnetically attractable object in the water toward the magnets disposed within the at least one housing so that the magnetically-attractable object is held at the at least one housing of the apparatus. The method still further includes raising the apparatus with the held object out the water.

The method may further include selectively magnetizing at least one of the magnets disposed within the at least one housing.

The method may further include transmitting a first signal to at least one of the magnets disposed within the at least one housing, receiving a second signal from the at least one of the magnets and determining whether the at least one housing has magnetically attracted the magnetically-attractable object based on the first and second signals.

The above object and other objects, features, and advantages of the present invention are readily apparent from the following detailed description of the best mode for carrying out the invention when taken in connection with the accompanying drawings.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Embodiments of the present invention generally provide an apparatus and a method for underwater retrieval of a magnetically-attractable object. The apparatus may also transmit a signal to indicate whether the apparatus has magnetically attracted a magnetically-attractable object.

Figure 1:
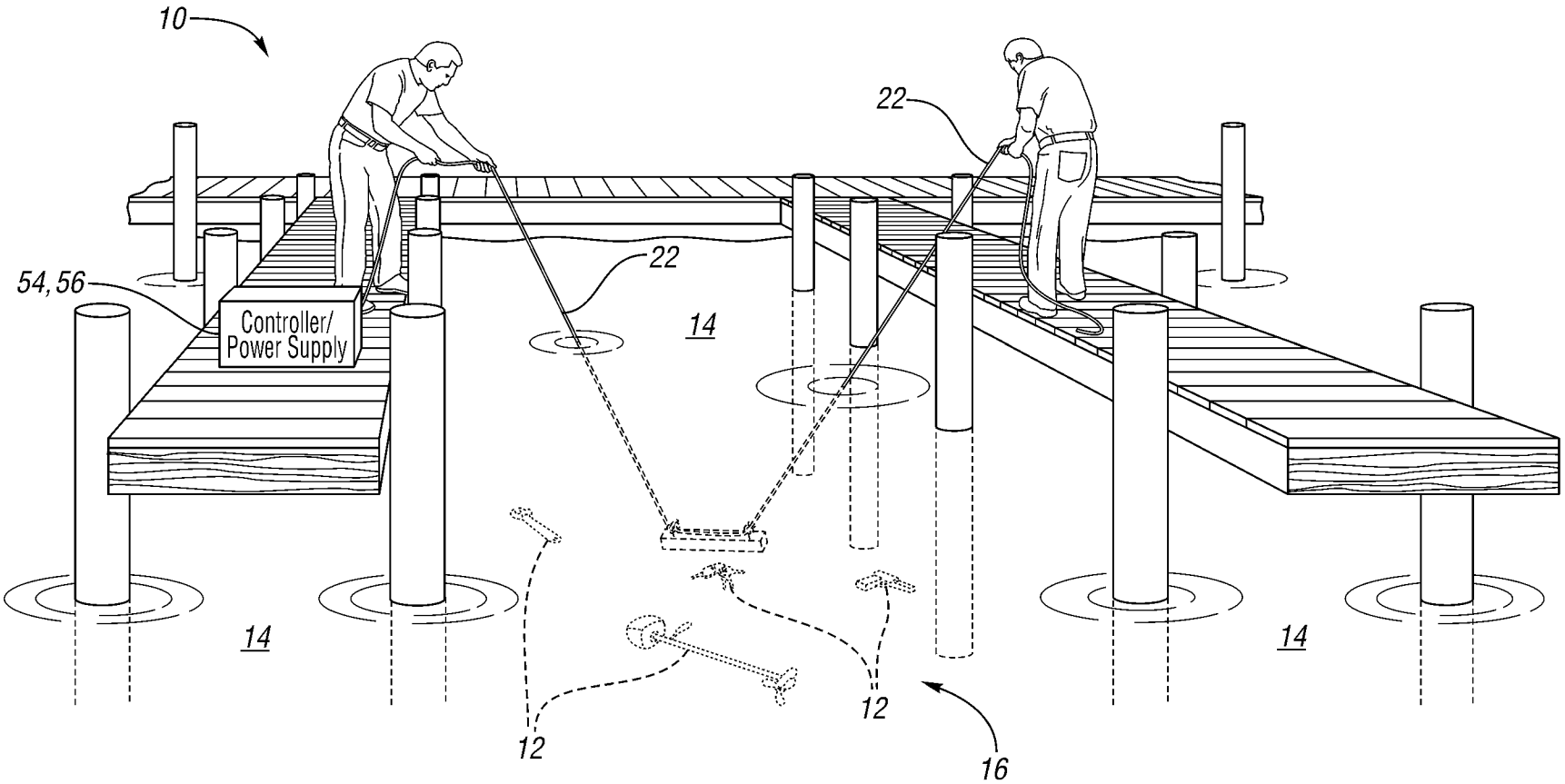
FIG. 1 is an environmental, perspective view illustrating an apparatus for underwater retrieval of at least one magnetically-attractable object and constructed in accordance with at least one embodiment of the present invention and illustrating a manner in which the apparatus may be used in a body of water in accordance with at least one method embodiment of the present invention.

With reference to FIG. 1, an apparatus, generally indicated at 10, for underwater retrieval of at least one magnetically attractable object 12 is generally provided. The apparatus 10 and its method of operation are described in an integrated manner to facilitate understanding of various aspects of the present invention.

With continuing reference to FIG. 1, the apparatus 10 for underwater retrieval of the magnetically attractable object 12 can be used by one or more persons in a body of water 14, such as water located in a dock slip 16 as illustrated in FIG. 1. Although FIG. 1 shows two individuals using the apparatus 10, the apparatus 10 may be used by a single individual (such as by securing one end of a line 22 about a piling at the slip 16) or a non-human-controlled device, such as a hoist or crane (not shown), above the water 14.

Figure 2:
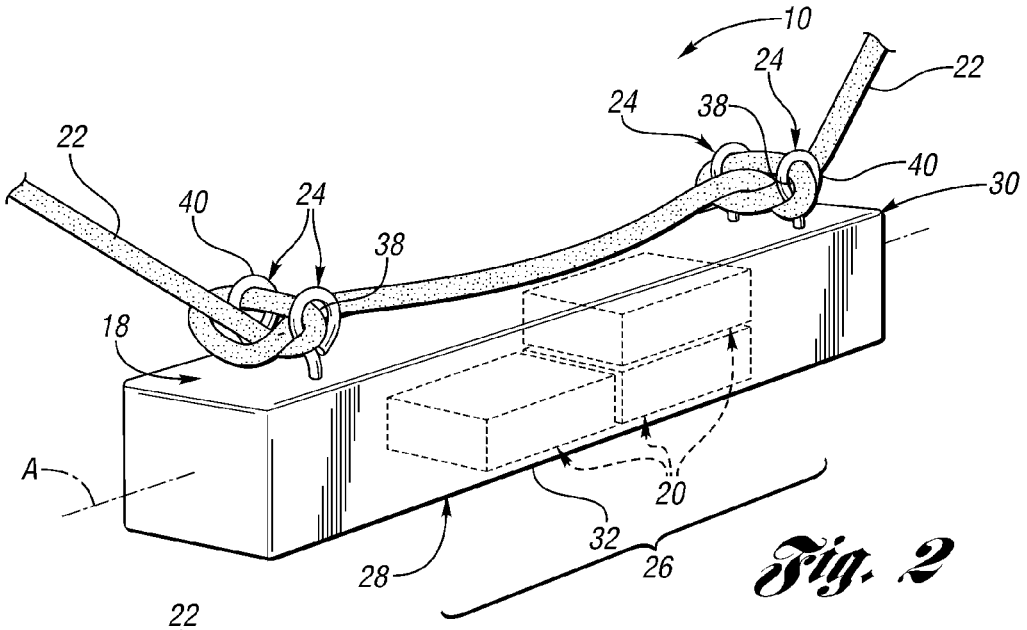
FIG. 2 is a partial perspective view illustrating an apparatus for underwater retrieval of at least one magnetically-attractable object and constructed in accordance with at least one embodiment of the present invention.

With reference to FIG. 2, at least one embodiment of the apparatus 10 may include at least one housing generally indicated at 18, a plurality of magnets 20 sealingly disposed within the housing 18, and the line 22 from which the housing 18 is suspended. The magnets 20 may be permanent magnets, electromagnets, or a combination thereof. In addition, the magnets 20 may be axially magnetized or diametrically magnetized, depending on the configuration of the apparatus 10. The housing 18 supports the formation of a magnetic field by allowing or enhancing a magnetic field produced by the magnets 20 to extend beyond the housing 18 and into the water 14. For example, at least a bottom portion of the housing 18 may be a ferromagnetic housing, such as corrosion-resistant steel alloy housing, to enhance a magnetic field in the water 14 produced by the magnets 20. Enhancing the magnetic field produced by the magnets 20 can increase the magnetic attractive force between the housing 18 and the magnetically-attractable object 12 in the water 14 to facilitate underwater retrieval of the magnetically-attractable object 12.

Figure 5:
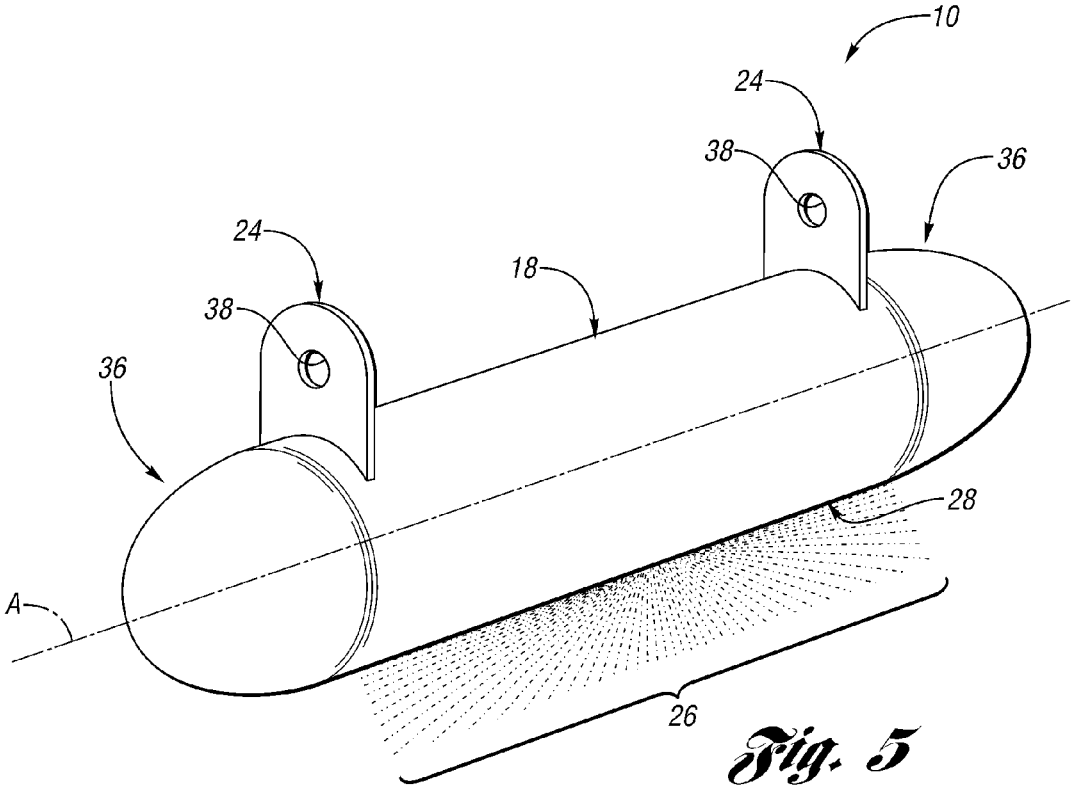
FIG. 5 is a perspective view illustrating an apparatus for underwater retrieval including a cylindrical, pill-shaped housing in accordance with at least one embodiment of the present invention.

As illustrated in FIG. 2, the housing 18 typically completely encloses and seals the magnets 20 to prevent water 14 from entering the housing 18 during the underwater retrieval of the magnetically-attractable object 12. The magnets 20 may be inserted in a hollow part of the housing 18 and then completely enclosed by one or more additional parts of the housing 18. For example, the magnets 20 may be inserted in a cavity defined by part of the housing 18 and then sealed within the housing 18, such by welding an end cap to the part of the housing 18 where the magnets 20 were inserted through and into the housing 18. Furthermore, the housing 18 may have a cylindrical pill shape (see FIG. 5). The cylindrical pill shape of the housing 18 may limit debris in the water 14 from interfering with movement of the housing 18 through the water during the underwater retrieval of the magnetically-attractable object 12.

As shown in FIG. 2, the housing 18 includes two spaced, apertured attachment portions 24. Furthermore, the housing 18 may define an intermediate portion 26 between the two spaced attachment portions 24. Most of the magnets 20 may be disposed within the intermediate portion 26 of the housing 18. The intermediate portion 26 may be elongated and/or have an elongated shape 28 and extend along a central axis A. In addition, the intermediate portion 26 may have a bar or box-like or rectangular shape 30 as illustrated in FIG. 2. The intermediate portion 26 may have a lower, planar surface 32 between the two spaced attachment portions 24. Most of the magnets 20 may be disposed immediately above the lower, planar surface 32 of the intermediate portion 26 of the housing 18 to facilitate underwater retrieval of the magnetically-attractable object 12.

Furthermore, the magnets 20 may be arranged in a tandem manner within the housing 18 to facilitate packing of the magnets 20 within the housing 18. Increased packing density of the magnets 20 can increase the magnetic density of the magnets along the lower surface of the housing 18, such as the lower planar surface 32, to increase the strength of a magnetic field produced by the magnets 20 in the water 14. Increasing the strength of a magnetic field produced by the magnets 20 in the water 14 can facilitate underwater retrieval of the magnetically attractable object 12.

Figure 6:
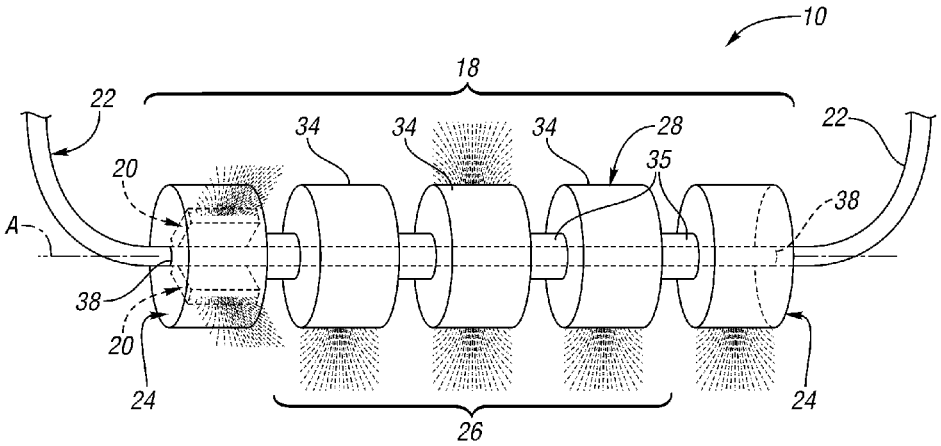
FIG. 6 is a partial perspective view illustrating an apparatus for underwater retrieval including a plurality of spaced intermediate parts constructed in accordance with at least one embodiment of the present invention.

As illustrated in FIG. 6, the intermediate portion 26 of the housing 18 may include a plurality of donut-shaped subunits 34 rotatably mounted on a line 22. A plurality of apertured spacers 35 separate the subunits 34 and are rotatably mounted on the line 22. Each of the donut-shaped subunits 34 includes at least one of the magnets 20 and may define a hole or inlet where the line 22 extends from the housing 18. For example, the line 22 may pass through the inlet of each of the donut-shaped intermediate portions to facilitate rotation of the donut-shaped intermediate portions about the line 22 and underwater retrieval of the magnetically attractable object 12. The donut-shaped subunits 34 may be positioned between the two spaced attachment portions 24 of the housing 18 to align each of the donut-shaped subunits 34 end-to-end or in tandem between the attachment portions 24.

Figure 7:
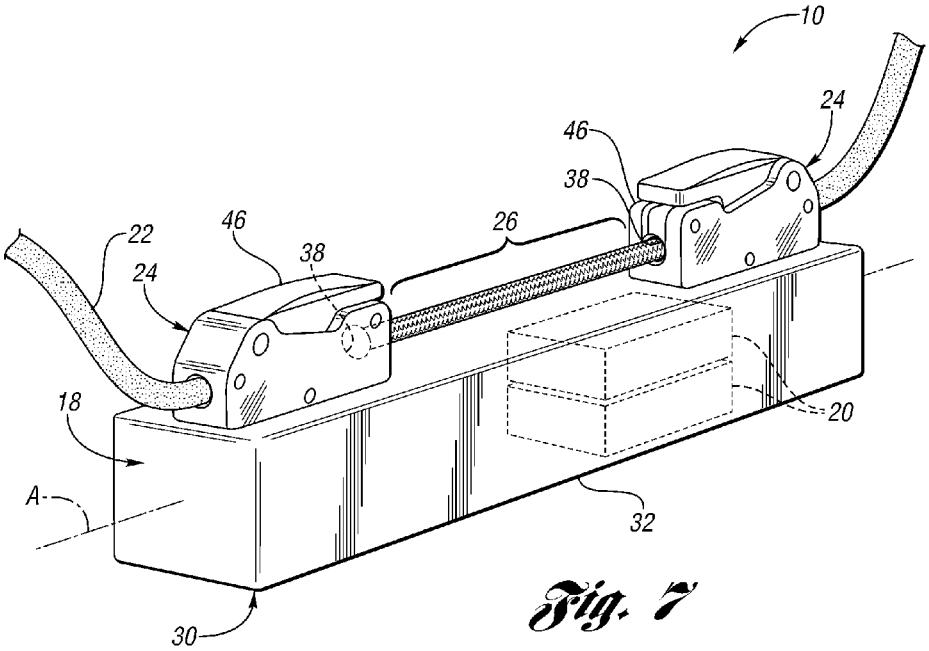
FIG. 7 is a partial perspective view illustrating yet another apparatus for underwater retrieval including a pair of spaced rope clutches.

The spaced attachment portions 24 may be at opposing ends 36 (FIG. 5) of the housing 18 with the at least one line 22 extending from each of the opposing ends 36. Each of the spaced attachment portions 24 may extend from the housing 18 during use and define an angle relative to a longitudinal axis A of the housing 18, the angle being between zero degrees and 90 degrees (FIGS. 2, 6 and 7). The spaced attachment portions 24 may extend in a single direction from the housing 18. The single direction from the housing 18 may be substantially perpendicular to longitudinal axis A of the housing, as shown in FIG. 2. Furthermore, the at least one line 22 can extend from the two spaced attachment portions 24 of the housing 18 in a second direction different from the single direction during underwater manipulation of the apparatus 10.

Figure 4:
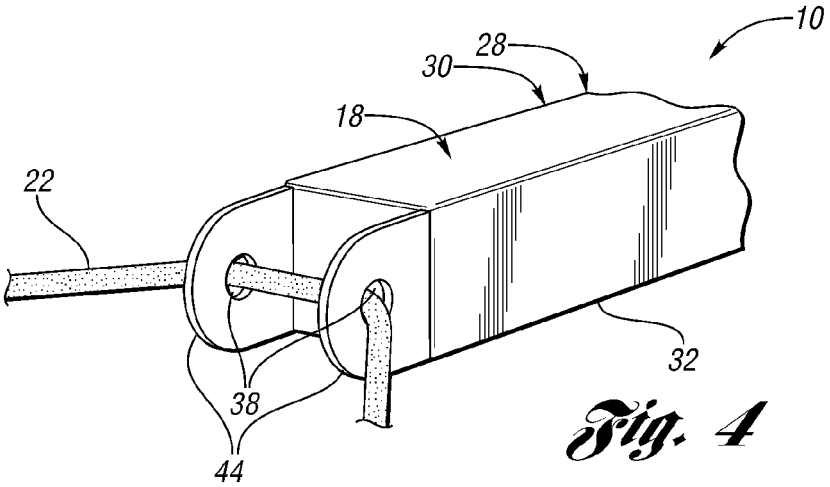
FIG. 4 is a partial perspective view similar to the view of FIG. 2, and illustrating an apparatus having at least one different attachment portion constructed in accordance with at least one embodiment of the present invention.

As shown in FIG. 2, one or more of the attachment portions 24 may define an inlet or hole 38 with the line 22 inserting through the inlet 38 and the line 22 being removably secured to one or more of the attachment portions 24. As shown in FIGS. 2 and 4, the inlet 38 of each of the spaced attachment portions 24 may define a pair of spaced openings which are coaxial with respect to each other. Likewise, the line 22 inserts coaxially through the inlets 38 of each of the spaced attachment portions 24 and extends from the housing 18 of the apparatus 10.

Figure 3:
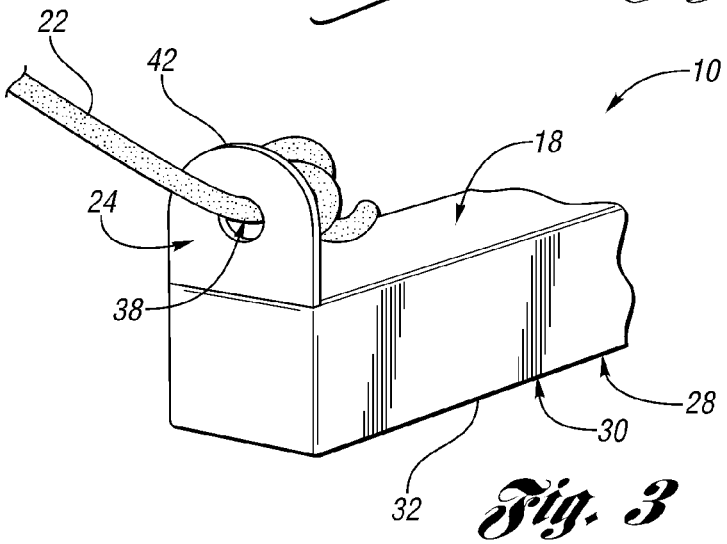
FIG. 3 is a partial perspective view similar to the view of FIG. 2, and illustrating an apparatus having at least one different attachment portion constructed in accordance with at least one embodiment of the present invention.

As shown in FIG. 2, the attachment portions 24 may include a single eye bolt 40 or a pair of eye bolts 40 depending on the configuration of the apparatus 10. Each eye bolt 40 may be a rod or wire bent into the shape of a loop to define the inlet 38 suitable for the line 22. In another example embodiment, the attachment portion 24 may be tab or ear 42 defining the inlet 38 (as shown in FIG. 3) or a pair of spaced tabs or ears 44, which define the inlet 38 (as shown in FIG. 4).

As shown in FIG. 7, each of the two spaced attachment portions 24 may comprise a rope or line clutch 46 (hereinafter "line clutch"). The pair of spaced line clutches 46 face in opposite directions to secure the line 22 near opposite ends 36 of the housing 18. Each line clutch 46 includes a lever handle that can be moved between an open position and a closed position. For example, the lever handle may pivot or swing away from the inlet 38 to the open position of the line clutch 46. The open position allows the line 22 to freely pass through the line clutch 46. In contrast, the closed position of the line clutch 46 secures the line 22 within the inlet 38 of the line clutch 46. The line clutch 46 may include teeth projections or serrations to grip or lock the line 22 to the line clutch 46 when the lever handle is in its closed position.

As depicted in FIGS. 1 and 2, the line 22 of the apparatus 10 extends from the two spaced attachment portions 24 of the housing 18. The line 22 facilitates underwater manipulation of the apparatus 10 and underwater retrieval of the magnetically-attractable object 12 from the water 14. The line 22 can be moved, such as in a dock slip 16 as illustrated in FIG. 1. Also, the line 22 may be moved or adjusted relative to the housing 18 during use of the apparatus 10. For example, as illustrated in FIG. 7, when the lever handle of the line clutch 46 is pivotally raised, the line clutch 46 in its open position and the inlet 38 of line clutch 46 permits the line 22 to freely pass through the line clutch 46 to facilitate adjustment of the line 22 relative to the housing 18. Permitting the line 22 to pass through the line clutch 46 allows the line 22 to be selectively repositioned relative to the housing 18, such as when the housing 18 is moved along the line 22 to a new position on the line 22 as during use of the apparatus 10.

Figure 8:
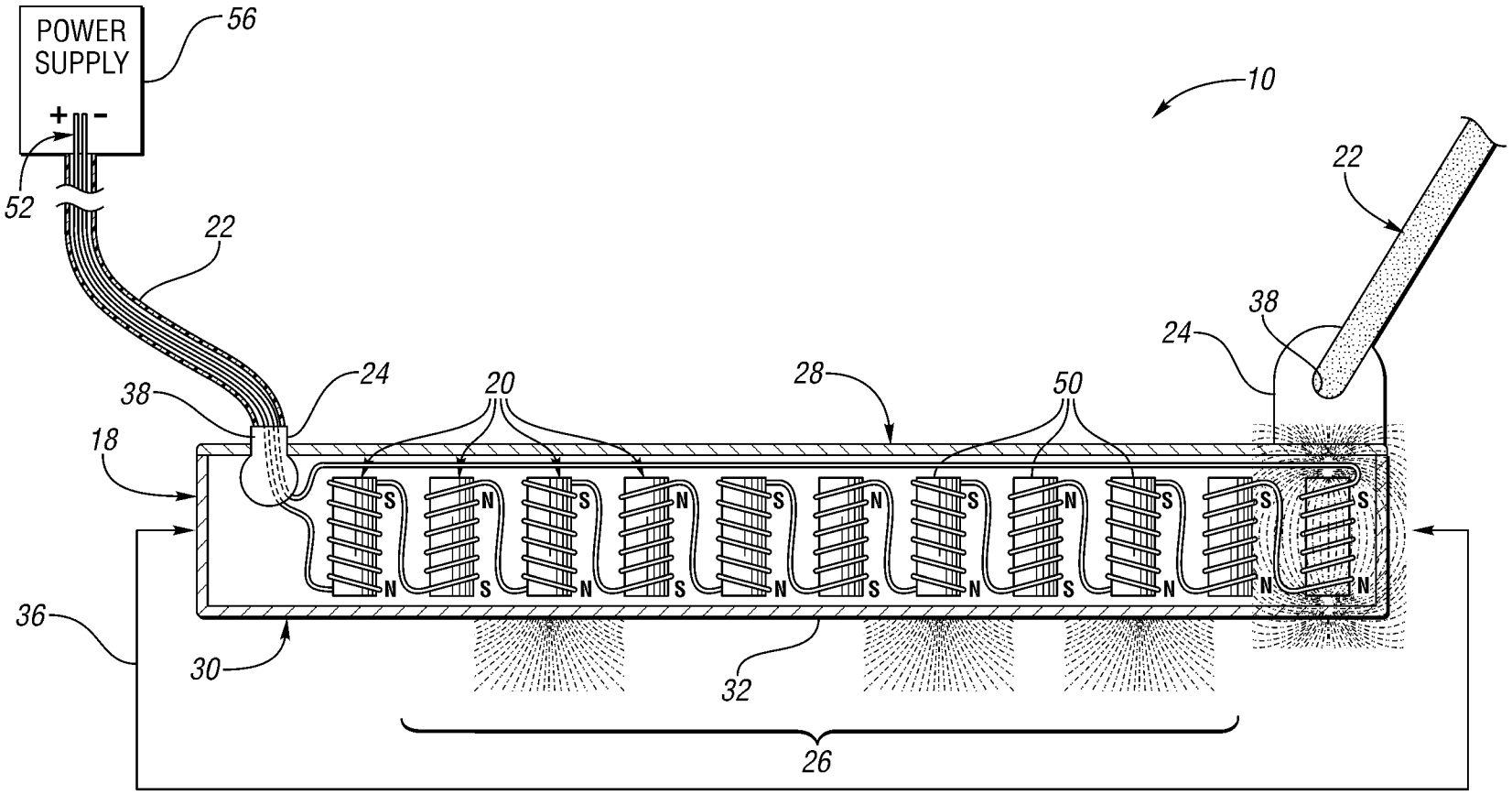
FIG. 8 is a schematic diagram illustrating an apparatus including electromagnets and an electrically conductive wire for selectively magnetizing the electromagnets in accordance with at least one embodiment of the present invention and for use in the environment of FIG. 1.

As shown in FIGS. 1 and 8, a DC power supply 56 is provided to energize a plurality of magnets 20 which may be electromagnets 50, and the line 22 may include an electrically conductive wire 52 connected to opposite poles of the power supply for conducting electricity which selectively magnetizes the electromagnets which are electrically and magnetically coupled together.

As shown in FIG. 1, the apparatus may also include a controller 54, such as a microcomputer or microcomputer coupled to the power supply 56 to transmit a first control signal through the electrically conductive wire 52 to the electromagnets of FIG. 8, to receive a second signal from the electromagnets 20, and to determine whether the magnetized housing 18 has magnetically attracted a magnetically-attractable object 12 based on at least one of the signals. For example, when an object 12 is held or suspended from the housing 18 the magnetic flux caused by the electromagnetics 20 changes thereby changing the current flow through the wire 52.

The controller/power supply 54, 56 may include a visual display or an audio alarm unit controlled by the controller 54 to indicate to a user of the apparatus 10 that an object 12 is being held or suspended from the housing 18.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus for underwater retrieval of a magnetically-attractable object, the apparatus comprising:

at least one housing having an upper surface, side surfaces, and a lower surface, each of the surfaces exposed to an outside environment, the at least one housing further including at least two spaced attachment portions;

at least one magnet disposed within the at least one housing,. wherein the at least one housing completely encloses the at least one magnet; and at least one line extending from the two spaced attachment portions of the at least one housing, the at least one line defining two opposing free ends, each free end spaced from one of the attachment portions, the at least one line between the attachment portions and the free ends enabling two users to hold one of the free ends with the housing located between the two users for underwater retrieval of magnetically-attractable objects between the users, and the upper surface, side surfaces, and lower surface of the at least one housing enhancing a magnetic field produced by the magnets to support formation of a magnetic field beyond the housing and to increase magnetic attractive force between the housing and the magnetically-attractable object during underwater retrieval of the magnetically-attractable object.

2. The apparatus of claim 1 wherein the at least one housing is a sealed corrosion-resistant housing which completely encloses the magnets to prevent water from entering the housing during the underwater retrieval of the magnetically-attractable object.

3. The apparatus of claim 1 wherein the at least one housing defines an elongated intermediate portion between the two spaced attachment portions, most of the magnets being disposed within the elongated intermediate portion of the at least one housing.

4. The apparatus of claim 1 wherein the at least one housing has a cylindrical pill shape to limit debris interference with the at least one housing during the underwater retrieval of the magnetically-attractable object.

5. The apparatus of claim 1 wherein the at least one housing has a bar-shaped intermediate portion defining a lower planar surface between the two spaced attachment portions, most of the magnets being disposed within the at least one housing above the lower planar surface of the bar-shaped intermediate portion of the at least one housing.

6. The apparatus of claim 1 wherein at least two of the spaced attachment portions define respective inlets, the inlets being spaced and coaxially aligned with respect to each other and wherein the at least one line is one line that extends between the inlets of the spaced attachment portions and away from the housing to facilitate underwater manipulation of the apparatus and underwater retrieval of the magnetically-attractable object toward the plurality of magnets.

7. The apparatus of claim 1 wherein the magnets are arranged in a stacked manner within the at least one housing between a lower surface of the housing and a upper surface of the housing.

8. The apparatus of claim 1 wherein the spaced attachment portions extend from the at least one housing and define an angle relative to each other along a longitudinal axis of the at least one housing, the angle being between zero degrees and 180 degrees.

9. The apparatus of claim 1 wherein the spaced attachment portions extend in a single direction from the at least one housing, the at least one line extending from the two spaced attachment portions of the housing in a second direction different from the single direction of the attachment portions during underwater manipulation of the apparatus.

10. The apparatus of claim 1 wherein each of the spaced attachment portions defines an inlet, the line inserting through the inlet of at least two of the spaced attachment portions and the line extending between inlets of the spaced attachment portions to facilitate underwater manipulation of the apparatus.

11. The apparatus of claim 1 wherein the at least one line is only a single line inserting coaxially through an inlet of each of the spaced attachment portions to facilitate underwater manipulation of the apparatus.

12. The apparatus of claim 1 wherein the spaced attachment portions are at opposing ends of the at least one housing, the at least one line extending horizontally between the opposing ends of the at least one housing.

13. An apparatus for underwater retrieval of a magnetically-attractable object, the apparatus comprising:

at least one housing having an upper ferromagnetic surface, side ferromagnetic surfaces, and a lower ferromagnetic surface, each of the surfaces exposed to an outside environment for contacting water and including at least two spaced attachment portions; and at least one magnet disposed within the at least one housing; and wherein each of the attachment portions is apertured to receive a line which extends from each of the two spaced attachment portions of the at least one housing to facilitate underwater manipulation of the apparatus, and the upper ferromagnetic surface, side ferromagnetic surfaces, and a lower ferromagnetic surface of the at least one housing enhancing a magnetic field produced by the at least one magnet to support formation of a magnetic field beyond the outer surface of the housing and into the water to increase magnetic attractive force between the outer surface of the housing and the magnetically-attractable object during underwater retrieval of the magnetically-attractable object.

14. The apparatus of claim 13, wherein at least two of the spaced attachment portions defining respective inlets, the inlets being coaxially aligned and spaced with respect to each other, and the attachment portions being apertured to receive the line extending between each of the two spaced attachment portions of the housing to facilitate underwater manipulation of the apparatus and underwater retrieval of the magnetically-attractable object.

15. A method of underwater retrieving a magnetically-attractable object, the method comprising:

providing an apparatus comprising:

at least one housing having a ferromagnetic outer surface for contacting water and including at least two spaced attachment portions;

a plurality of magnets disposed within the at least one housing and the housing enhancing a magnetic field produced by the magnets to support formation of a magnetic field beyond the outer surface of the housing; and at least one line extending from the two spaced attachment portions of the at least one housing, the at least one line defining two opposing free ends, each free end spaced from one of the two attachment portions and controllable by a user;

lowering the apparatus into water;

with two users controlling a respective one of the free ends of the line, moving the line to move the apparatus in the water towards the at least one magnetically-attractable object to attract the magnetically-attractable object in the water toward the magnets disposed within the at least one housing and the housing increasing magnetic attractive force between the housing and the magnetically-attractable object so that the magnetically-attractable object is held at the at least one housing of the apparatus; and raising the apparatus with the held object out of the water.

* * * * *